US010716409B2

(12) United States Patent
Creekmuir et al.

(10) Patent No.: US 10,716,409 B2
(45) **Date of Patent: *Jul. 21, 2020**

(54) SMART RESPONSE TECHNOLOGY MATTRESS

(71) Applicant: DREAMWELL, LTD., Las Vegas, NV (US)

(72) Inventors: William C. Creekmuir, Atlanta, GA (US); Richard F. Gladney, Fairburn, GA (US)

(73) Assignee: DREAMWELL, LTD., Doraville, GA (US)

( * ) Notice: Subject to any disclaimer, the term of this patent is extended or adjusted under 35 U.S.C. 154(b) by 818 days.

This patent is subject to a terminal disclaimer.

(21) Appl. No.: 14/718,123

(22) Filed: May 21, 2015

(65) Prior Publication Data

US 2015/0335165 A1 Nov. 26, 2015

Related U.S. Application Data

(60) Provisional application No. 62/001,701, filed on May 22, 2014.

(51) Int. Cl.

| | |
|---|---|
| ***A47C 17/00*** | (2006.01) |
| ***A47C 27/15*** | (2006.01) |
| ***A47C 27/08*** | (2006.01) |
| ***A47C 27/05*** | (2006.01) |
| *A47C 27/10* | (2006.01) |
| *A47C 27/20* | (2006.01) |

(52) U.S. Cl.

CPC ..... *A47C 27/15* (2013.01); *A47C 27/05* (2013.01); *A47C 27/08* (2013.01); *A47C 27/10* (2013.01); *A47C 27/20* (2013.01)

(58) Field of Classification Search

CPC ..... A47C 31/123; A47C 23/04; A47C 27/081; A47C 27/083; A47C 27/088; A47C 27/10; A47C 27/20; A47C 27/085; A47C 27/08; A47C 27/14; A47C 27/15

See application file for complete search history.

(56) References Cited

U.S. PATENT DOCUMENTS 2,489,596 A * 11/1949 Walter ..... F16K 37/00 137/553
5,090,077 A * 2/1992 Caden ..... A61G 7/05715 5/713

(Continued)

*Primary Examiner* — Nicholas F Polito
*Assistant Examiner* — Morgan J McClure
(74) *Attorney, Agent, or Firm* — Cantor Colburn LLP

(57) ABSTRACT

Smart response technology mattresses generally includes a sub-core assembly including a self-adjusting, non-powered smart response unit and a polyurethane foam circumscribing a perimeter of the smart response unit and having a thickness equal to or less than a thickness of the smart response unit, wherein the smart response unit comprises a plurality of fluid support cells, wherein each fluid support cell includes an envelope and a reforming element disposed within the envelope; a manifold system including a manifold conduit interconnecting at least two of the fluid support cells, and intake and exhaust valves fluidly coupled to the manifold conduit configured to dynamically open and close in response to a weight load. The mattresses include additional foam layers overlaying the sub-core assembly to define the smart response technology mattresses.

17 Claims, 7 Drawing Sheets

(56) References Cited

U.S. PATENT DOCUMENTS 5,539,942 A * 7/1996 Melou ..... A61G 7/05776 5/655.3
6,263,533 B1 * 7/2001 Dimitry ..... A47C 27/066 5/717
6,269,505 B1 * 8/2001 Wilkinson ..... A47C 27/084 5/654
6,775,868 B1 * 8/2004 Mileti ..... A47C 27/001 5/710
6,826,795 B2 12/2004 Wilkinson
7,082,635 B2 * 8/2006 Barman ..... A47C 27/053 5/717
7,155,765 B2 * 1/2007 Fogg ..... A47C 27/148 5/691
7,434,283 B2 * 10/2008 Wilkinson ..... A47C 27/084 5/710
7,617,554 B2 * 11/2009 Wilkinson ..... A47C 27/083 5/655.3
7,617,788 B2 * 11/2009 Rensink ..... A47C 27/001 112/420
7,690,096 B1 4/2010 Gladney
8,122,545 B2 2/2012 Wilkinson
8,296,976 B2 * 10/2012 Murphy ..... A47C 27/08 40/320
8,512,854 B2 * 8/2013 Fox ..... A43B 1/0072 428/316.6
8,863,336 B2 * 10/2014 Theosabrata ..... A47C 19/025 5/652.1
8,881,328 B2 * 11/2014 Mikkelsen ..... A47C 21/044 5/423
8,997,279 B1 * 4/2015 McKay ..... A47C 23/002 5/423
2003/0192127 A1 * 10/2003 Cook ..... A47C 27/00 5/713
2005/0062284 A1 * 3/2005 Schreiner ..... F16K 15/202 285/139.1
2005/0155154 A1 * 7/2005 Kasatshko ..... A47C 4/54 5/713
2008/0028534 A1 * 2/2008 Wilkinson ..... A47C 27/083 5/713
2009/0183314 A1 * 7/2009 Demoss ..... A47C 27/05 5/716
2010/0180384 A1 * 7/2010 Balonick ..... A47C 27/082 5/709
2013/0025070 A1 * 1/2013 Ruehlmann ..... A47C 27/15 5/740
2013/0067662 A1 * 3/2013 Jusiak ..... B32B 3/26 5/724
2013/0232698 A1 * 9/2013 Ward ..... A47C 21/00 5/659
2014/0090176 A1 * 4/2014 Boyd ..... A47C 27/10 5/710
2014/0319890 A1 * 10/2014 Rivera ..... A47C 7/467 297/284.4
2015/0034855 A1 * 2/2015 Shen ..... F16K 3/0254 251/314

* cited by examiner

SMART RESPONSE TECHNOLOGY MATTRESS

CROSS REFERENCE TO RELATED APPLICATIONS

This application is a NON-PROVISIONAL of and claims the benefit of U.S. application Ser. No. 62/001,701, filed May 22, 2014, which is incorporated herein by reference in its entirety.

BACKGROUND

The present disclosure generally relates to a smart response technology mattress.

Smart response technology (SRT) based mattresses are non-powered and include a plurality of foam-filled air chambers in the middle of the mattress that uses a pressure relief valve and a series of intake valves to pass air in and out of the system as weight is applied. The system dynamically adjusts to a person as they move around in bed displacing their weight to provide optimal pressure relief.

BRIEF SUMMARY

Disclosed herein are non-powered smart response technology mattresses with improved user comfort. In one embodiment, the smart response technology mattress includes a sub-core assembly including a base layer, wherein the base layer is a pre-stressed polyurethane foam; a second layer overlaying the base layer comprising a self-adjusting, non-powered smart response unit and a polyurethane foam circumscribing a perimeter of the smart response unit and having a thickness equal to or less than a thickness of the smart response unit, wherein the smart response unit comprises a plurality of fluid support cells, wherein each fluid support cell includes an envelope and a reforming element disposed within the envelope; a non-powered manifold system including a manifold conduit interconnecting at least two of the fluid support cells, and intake and exhaust valves fluidly coupled to the manifold conduit configured to dynamically open and close in response to a weight load; and an elastic conformance layer overlaying a planar surface defined by the smart response unit and the polyurethane foam circumscribing the perimeter of the smart response unit; a viscoelastic foam layer overlaying the sub-core having a convoluted top surface and a planar bottom surface; and a cover layer overlaying the viscoelastic foam layer, the cover layer comprising a viscoelastic foam having planar top and bottom surfaces.

In another embodiment, the smart response technology mattress includes a sub-core assembly including a base layer, wherein the base layer is a pre-stressed polyurethane foam; a second layer overlaying the base layer comprising a self-adjusting, non-powered smart response unit and a polyurethane foam circumscribing a perimeter of the smart response unit and having a thickness equal to or less than a thickness of the smart response unit, wherein the smart response unit comprises a plurality of fluid support cells, wherein each fluid support cell includes an envelope and a reforming element disposed within the envelope; a non-powered manifold system including a manifold conduit interconnecting at least two of the fluid support cells, and intake and exhaust valves fluidly coupled to the manifold conduit configured to dynamically open and close in response to a weight load; and an elastic conformance layer overlaying a planar surface defined by the smart response unit and the polyurethane foam circumscribing the perimeter of the smart response unit; a latex foam layer overlaying the sub-core having a planar top and bottom surface; a viscoelastic foam layer overlaying the latex foam layer having a convoluted top surface and a planar bottom surface; and a cover layer overlaying the layer overlaying the sub-core, the cover layer comprising a viscoelastic foam having planar top and bottom surfaces.

In yet another embodiment, the smart response technology mattress includes a sub-core assembly including a base layer, wherein the base layer is a pre-stressed polyurethane foam; a second layer overlaying the base layer comprising a self-adjusting, non-powered smart response unit and a polyurethane foam circumscribing a perimeter of the smart response unit and having a thickness equal to or less than a thickness of the smart response unit, wherein the smart response unit comprises a plurality of fluid support cells, wherein each fluid support cell includes an envelope and a reforming element disposed within the envelope; a non-powered manifold system including a manifold conduit interconnecting at least two of the fluid support cells, and intake and exhaust valves fluidly coupled to the manifold conduit configured to dynamically open and close in response to a weight load; and an elastic conformance layer overlaying a planar surface defined by the smart response unit and the polyurethane foam circumscribing the perimeter of the smart response unit; a first viscoelastic foam layer overlaying the sub-core having a planar top and bottom surfaces; a second viscoelastic foam layer overlaying the first viscoelastic foam layer having a convoluted top surface and a planar bottom surface; and a cover layer overlaying the layer overlaying the sub-core, the cover layer comprising a viscoelastic foam having planar top and bottom surfaces.

The disclosure may be understood more readily by reference to the following detailed description of the various features of the disclosure and the examples included therein.

BRIEF DESCRIPTION OF THE SEVERAL VIEWS OF THE DRAWINGS

Referring now to the figures wherein the like elements are numbered alike.

DETAILED DESCRIPTION

Disclosed herein are smart response technology mattresses providing improved user comfort. The mattresses generally include a common sub-core including a self-calibrating non-powered smart response unit that responds and adapts to the end-user by using support cells that dynamically inflate and deflate based on movement of the end-user regardless of size, weight or sleeping position. The smart response unit includes at least one support cell for providing lifting support for a body. Each support cell includes an envelope containing a fluid. Application of an external load on an outer surface of the envelope causes the envelope to deform into a compressed form. The envelope includes a reforming element that is capable of providing a reforming force to the interior surface of the envelope, to return the envelope to its original unloaded form. The reforming element is preferably made from a resilient foam material; however, other resilient means can be used.

An intake valve and an exhaust valve are typically included in each support cell. The exhaust valve in each support cell is connected to an exhaust control system. The intake valve in each support cell is connected to an intake control system. Each intake valve may include an intake check valve allowing fluid to flow into the support cell, while preventing fluid from flowing out of the support cell. Alternatively, fluid may flow freely from one support cell to another support cell, wherein all cells in the system are controlled by a common intake and exhaust valve. Each exhaust valve can include an exhaust check valve allowing fluid to flow out of the support cell, while preventing fluid from flowing into the support cell. The intake control system is connected to a fluid supply reservoir. The exhaust control system is connected to a fluid exhaust reservoir. Preferably, the fluid included in the supply and exhaust reservoirs is air, however, any suitable fluid, e.g., water or nitrogen, can be used. The fluid supply and exhaust reservoirs may comprise the same reservoir, and may comprise an ambient source of fluid such as atmospheric air. Alternatively, the exhaust and intake valves are in fluid communication to a manifold that is in fluid communication with the support cells. For example, the intake and exhaust valves may be disposed at the ends of the manifold. Exemplary support cells are disclosed in in US Pub. No. 2008/0028534; and U.S. Pat. Nos. 7,434,283; 8,122,545; 7,617,554; 6,826,795; and 6,269,505, the disclosures of which are incorporated by reference in their entireties.

Figure 1:
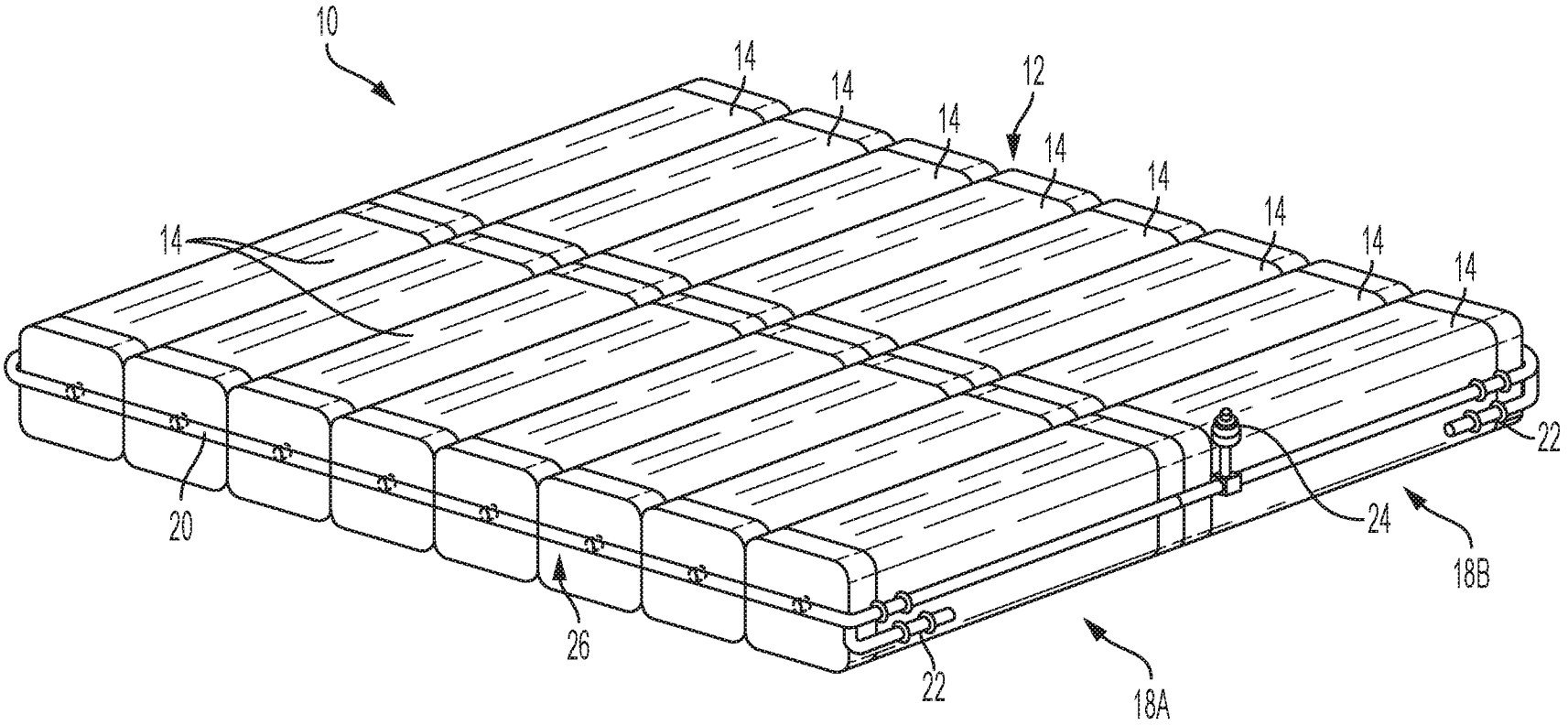
FIG. 1 illustrates a partial perspective view of a mattress of the present invention.

Turning now to FIG. 1, there is illustrated a perspective view of an exemplary SRT based cushioning device 10 in accordance with the present disclosure. As discussed above, the SRT based cushioning device can be encapsulated in numerous other layers to define a mattress or other cushioning article. The SRT based cushioning device 10 includes a non-powered fluid support system apparatus 12 including at least one fluid support cell 14 for providing lifting support for a user. In the illustrated embodiment, there are 16 support cells arranged in two abutting columns 18A, 18B, wherein each column includes eight support cells. Each support cell 14 is fluidly coupled to a common conduit 20, i.e., the manifold. The conduit 20 includes at least one intake valve 22, two of which are depicted, and at least one exhaust valve 24, one of which is shown, to collectively define the manifold 26, which are configured to dynamically open and close at defined pressures in response to a weight load.

Figure 2:
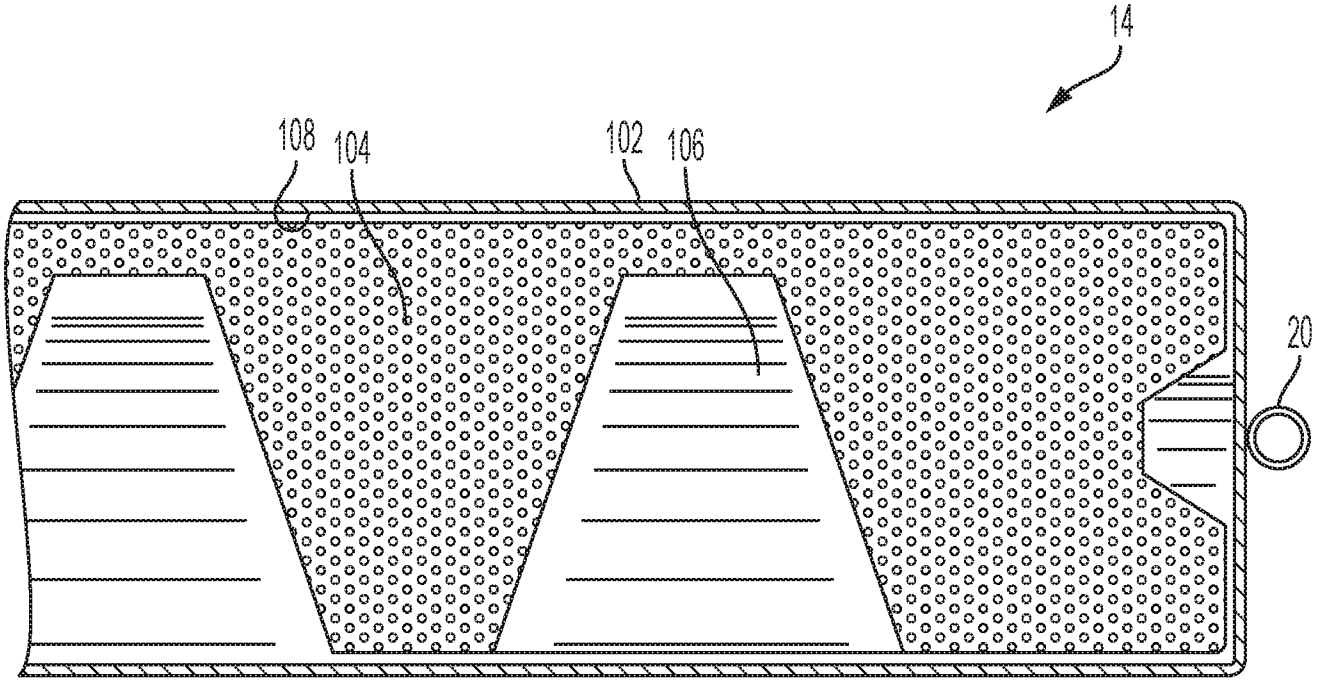
FIG. 2 illustrates a partial cross-sectional view of a support cell including a reforming element and an intake valve.

FIG. 2 illustrates an enlarged partial cross-sectional view, respectively, of the support cell 14. Each individual support cell 14 includes an envelope 102 and a reforming element 104 disposed therein. The envelope 102 also contains a fluid 106. During use, application of an external load on the envelope 102 causes the envelope 102 to deform into a compressed form and air to be discharged into the manifold conduit 20. The reforming element 104 provides a reforming force to the interior surface 108 of the envelope 102 and causes the envelope 102 to return relatively slowly to its original form when the external load is removed from the envelope 102. The reforming element 104 can be a resilient foam material; however, other resilient materials and means can be used such as a coiled spring, bellows or the like. By way of example, the coiled spring can be surrounded by another resilient material such as a foam. The bellows may be formed from a pliable resilient material such as plastic and filled with a fluid such as air.

Figure 3A:
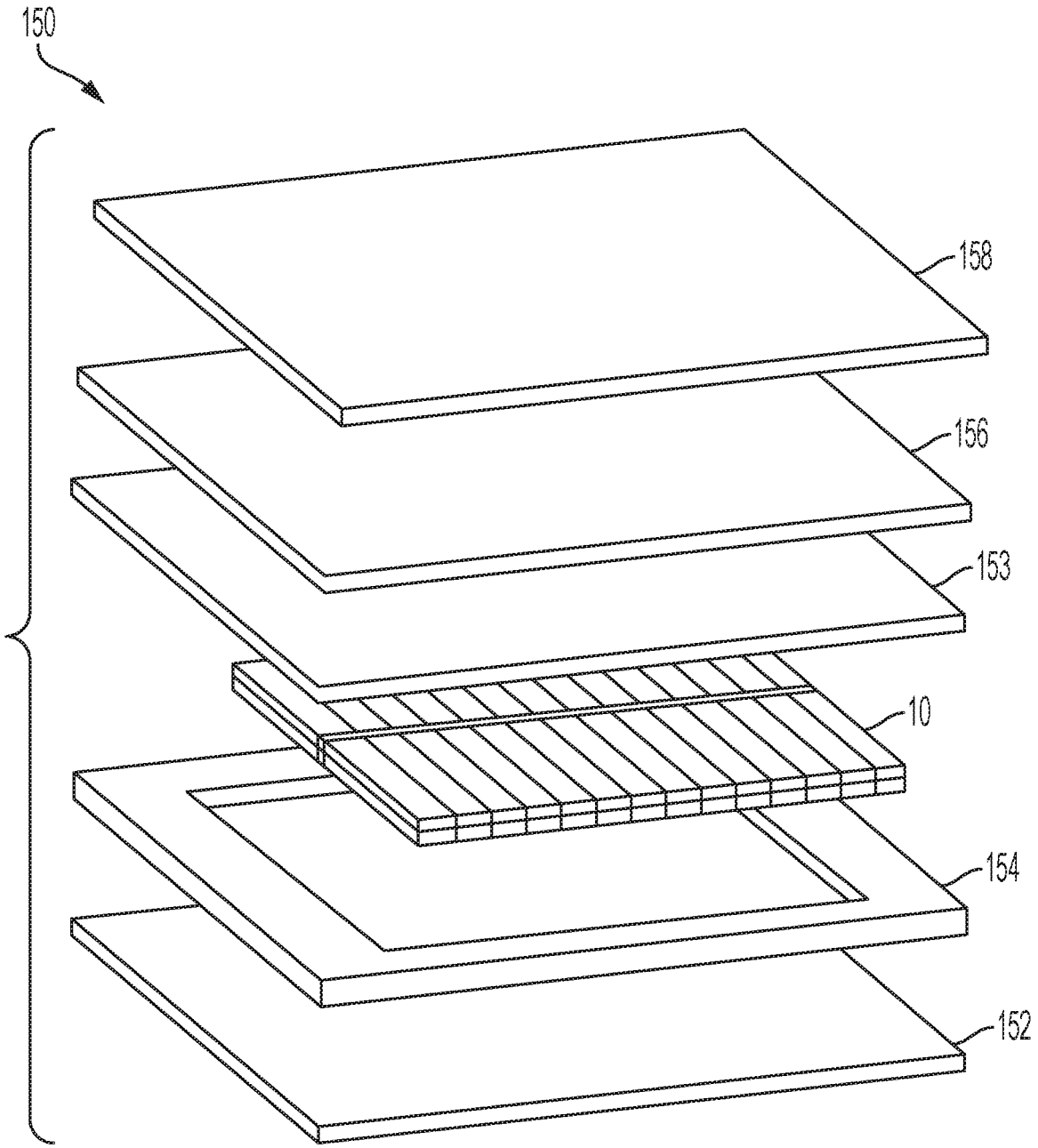
FIG. 3A illustrates an exploded perspective view of a smart response technology mattress in accordance with an embodiment of the present disclosure.

FIG. 3 illustrates an exploded perspective view of a mattress 150 including the smart response technology body cushioning device 10 in accordance with an embodiment of the present disclosure. The mattress 150 generally includes as sub-core assembly, which includes a base layer 102. In one embodiment, the base foam, layer 152 can be formed of a standard polyurethane foam layer including planar top and bottom surfaces. In one embodiment, the polyurethane foam layer is pre-stressed. Suitable pre-stressed polyurethane foams are generally formed in the manner disclosed in U.S. Pat. No. 7,690,096 to Gladney et al., incorporated herein by reference in its entirety. By way of example, a force can applied to at least a section of a standard polyurethane foam layer in an amount sufficient to temporarily compress its height so as to permanently alter a mechanical property of the foam layer to provide a pre-stressed foam layer having a firmness that is different from the firmness of a similar polyurethane foam that was not pre-stressed. The pre-stressed polyurethane foam layer is a standard polyurethane foam as noted above, typically not viscoelastic, and generally has a pre-stressed thickness of less than 1 inch to 4 inches. The density is generally less than 2.5 $lb/ft^3$ to 0.5 $lb/ft^3$ in some embodiments, and less than 2 $lb/ft^3$ to 1 $lb/ft^3$ in still other embodiments. The hardness is generally less than 60 pounds-force to 10 pounds-force in some embodiments, and less than 50 pounds-force to 30 pounds-force in still other embodiments. In one embodiment, the thickness is 2.25 inches, the hardness is 45 pounds-force, and the density is 1.5 $lb/ft^3$.

Disposed on the planar top surface of base layer 152 is the smart response technology body cushioning device 10, also referred to herein as a smart response unit, which includes one or more support cells such as described above in FIGS. 1-2. In one embodiment, the smart response unit includes two 8-chamber support cells, wherein each one of the 8-chamber support cells are adjacent to one another and generally configured and oriented to support an individual user.

Figure 3B:
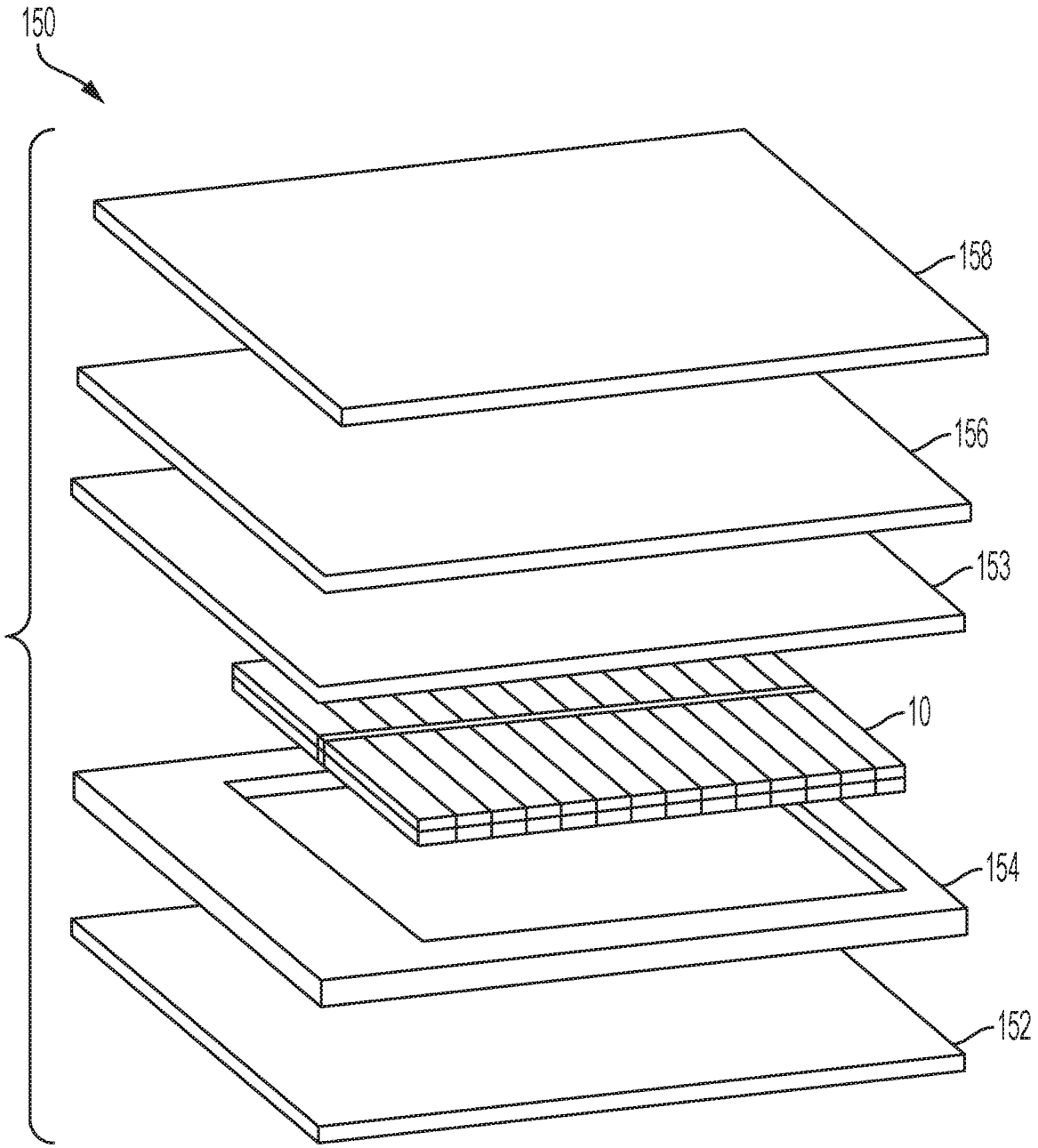
FIG. 3B illustrates an exploded perspective view of a smart response technology mattress in accordance with an embodiment of the present disclousre.

The smart response unit 10 is disposed in an opening defined by an foam edge support 154 that circumscribes the perimeter the smart response unit. The foam edge support 154 generally defines the side rail assembly for the assembled mattress. The foam edge support has a thickness of about the same or less than the thickness of the smart response unit. By way of example, the thickness of the smart response unit 10 can be 5.5 inches and the thickness of the edge support 104 can be 5.25 inches. In one embodiment, the recess is off-center lengthwise such that the smart response unit 106 is oriented more towards the head portion of the mattress as is shown in FIG. 3B. By way of example, the sides can have a width of 5.25 inches, the head end can have a width of 9 inches and the foot end can have a width of 21 inches.

In one embodiment, the foam edge support 154 is formed of a polyurethane foam having a density generally less than 3 $lb/ft^3$ and a hardness greater than 30 pounds-force. In one embodiment, the foam edge support 104 is formed of having a density of 1.65 lb/ft$^3$ and a hardness of 45 pounds-force.

In another embodiment, the foam edge support 154 is formed of open cell polyurethane foam having a non-random large cell structure or a random cellular structure with many large cells. The large cell structure can be defined by the number of cells per linear inch. In one embodiment, the large cell structure is about 10 to 40 cells per inch, with about 15 to 30 cells per inch in other embodiments, and with about 20 cells per inch in still other embodiments. The open cell foam structure includes a plurality of interconnected cells, wherein the windows between the adjacent cells are broken and/or removed. In contrast, in a closed cell foam there are substantially no interconnected cells and the windows between the adjacent cells are substantially intact. In reticulated foams, substantially all of the windows are removed. By using an open cell structure with a large open cellular structure, movement of moisture and air through a foam edge support 154 can occur. Also, if the foam edge support 254 is adhesively or thermally attached to any of the mattress layers, the skeletal struts of the open cell foam will bond to the mattress layers, thereby facilitating air and moisture transfer from the mattress layers through the side layers to the environment. In one embodiment, the foam edge support 154 includes a reticulated viscoelastic polyurethane foam.

For ease in manufacturing the mattress assembly, the foam edge support 104 may be assembled in linear sections that are joined to one another to form the perimeter about the mattress layers. The ends may be square or may be mitered depending on the manufacturing process.

An elastic conformance layer 153 can overlay the smart response unit 10 and the foam edge support 154

A viscoelastic polyurethane foam layer 156 having a convoluted top surface and a planar bottom surfaces can overlay the elastic conformance layer or the planar surface defined by the support unit 10 and foam edge support 154. The viscoelastic foam layer can generally be characterized as having a thickness greater than 1 inch to about 3 inches, a density of less than 1 to 3 1 lb/ft$^3$, and a hardness of 5 to 20 pounds-force. In one embodiment, the viscoelastic polyurethane foam layer has a thickness of 2 inches, a density of about 2.1 lb/ft$^3$, and a hardness of 9 pounds-force. The convolutions are ⅜ of an inch.

The mattress may further include a cover panel 158, which may also be formed of a viscoelastic foam disposed on an underlying foam layer. The cover panel typically has planar top and bottom surfaces, a density of 1 to 5 lb/ft$^3$, a hardness of 5 to 20 pounds-force, and a thickness of 0.5 to 3 inches. In one embodiment, the cover panel has a thickness of 1 inch, a density of about 3.7 lb/ft$^3$, and a hardness of about 9.5 pounds-force.

The assembled mattress may further include mattress cover (not shown) encapsulating the various layers defining the mattress, which may be quilted or non-quilted.

Figure 4:
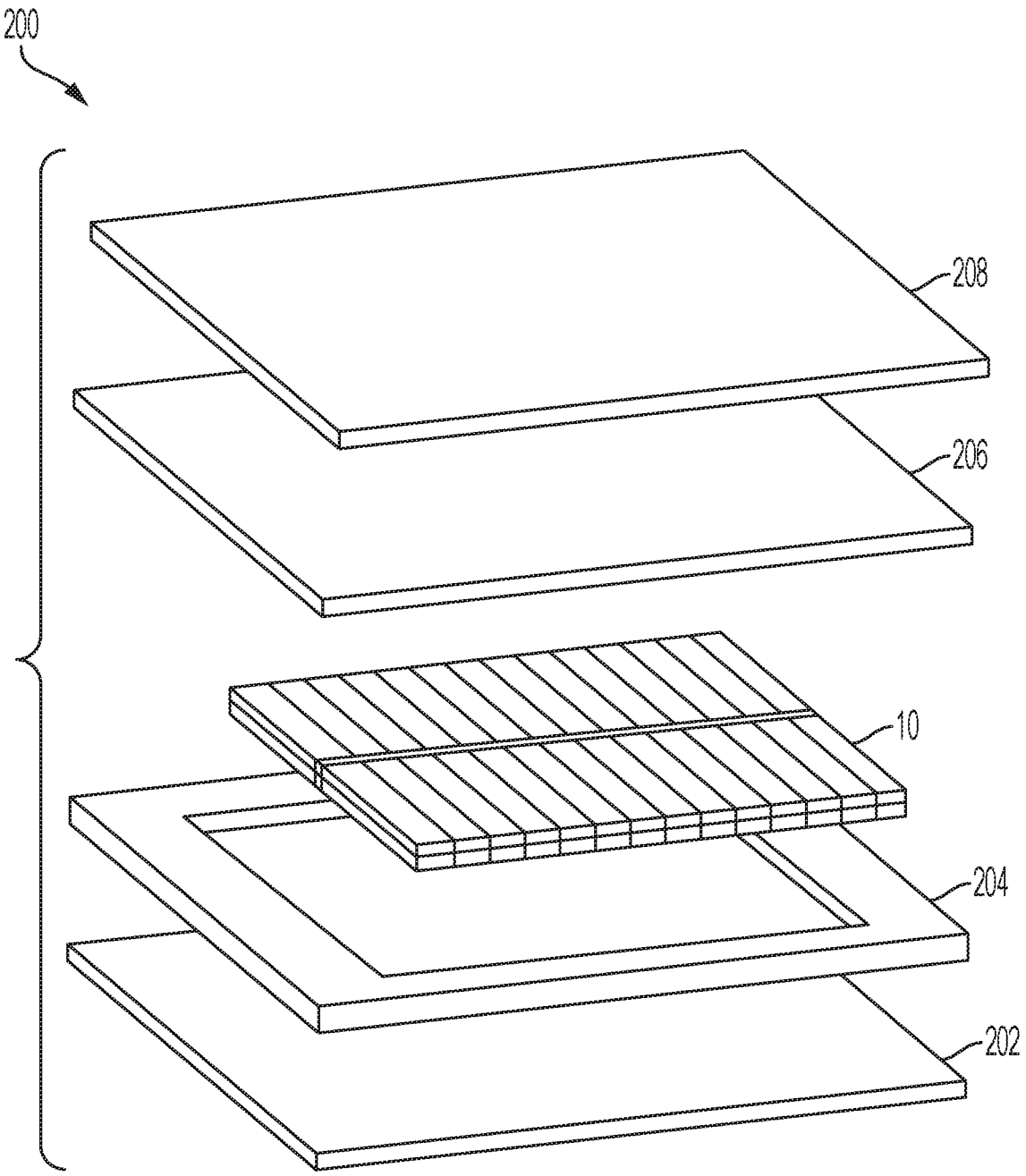
FIG. 4 illustrates an exploded perspective view of a smart response technology mattress in accordance with an embodiment of the present disclosure.

Turning now to FIG. 4, there is shown an exploded perspective view of a smart technology mattress in accordance with another embodiment. The smart response technology mattress 200 includes a base foam layer 202. In one embodiment, the base foam, layer 202 can be formed of a standard polyurethane foam layer including planar top and bottom surfaces. In one embodiment, the polyurethane foam layer is pre-stressed. The pre-stressed polyurethane foam layer is a standard polyurethane foam as noted above (i.e., not viscoelastic) and generally has a pre-stressed thickness of less than 1 inch to 4 inches. The density is generally less than 2.5 lb/ft$^3$ to 0.5 lb/ft$^3$ in some embodiments, and less than 2 lb/ft$^3$ to 1 lb/ft$^3$ in still other embodiments. The hardness is generally less than 60 pounds-force to 10 pounds-force in some embodiments, and less than 50 pounds-force to 30 pounds-force in still other embodiments. In one embodiment, the thickness is 2.25 inches, the hardness is 45 pounds-force, and the density is 1.5 lb/ft$^3$.

Disposed on the planar top surface of base layer 202 is a smart response unit 10 of one or more support cells such as described above in FIG. 1. In one embodiment, the smart response unit 10 includes two 8-chamber support cells, wherein each one of the 8-chamber support cells are adjacent to one another and generally configured and oriented to support an individual user.

The smart response unit 10 is disposed in an opening defined by an foam edge support 204 that circumscribes the perimeter the smart response unit. The foam edge support 204 generally defines the side rail assembly. The foam edge support has a thickness of about the same or less than the thickness of the smart response unit. By way of example, the thickness of the smart response unit 206 is 5.5 inches and the thickness of the edge support 204 is 5.25 inches. In one embodiment, the recess is off center lengthwise such that the smart response unit 10 is oriented more towards the head portion of the mattress. By way of example, the sides can have a width of 5.25 inches, the head end can have a width of 9 inches and the foot end can have a width of 21 inches.

In one embodiment, the foam edge support 204 is formed of a polyurethane foam having a density generally less than 3 lb/ft$^3$ and a hardness greater than 30 pounds-force. In one embodiment, the foam edge support 204 is formed of having a density of 1.65 lb/ft$^3$ and a hardness of 45 pounds-force.

In another embodiment, the foam edge support 204 is formed of open cell polyurethane foam having a non-random large cell structure or a random cellular structure with many large cells. The large cell structure can be defined by the number of cells per linear inch. In one embodiment, the large cell structure is about 10 to 40 cells per inch, with about 15 to 30 cells per inch in other embodiments, and with about 20 cells per inch in still other embodiments. The open cell foam structure includes a plurality of interconnected cells, wherein the windows between the adjacent cells are broken and/or removed. In contrast, in a closed cell foam there are substantially no interconnected cells and the windows between the adjacent cells are substantially intact. In reticulated foams, substantially all of the windows are removed. By using an open cell structure with a large open cellular structure, movement of moisture and air through a foam edge support 204 can occur. Also, if the foam edge support 204 is adhesively or thermally attached to any of the mattress layers, the skeletal struts of the open cell foam will bond to the mattress layers, thereby facilitating air and moisture transfer from the mattress layers through the side layers to the environment. In one embodiment, the foam edge support 204 includes a reticulated viscoelastic polyurethane foam.

For ease in manufacturing the mattress assembly, the foam edge support 204 may be assembled in linear sections that are joined to one another to form the perimeter about the mattress layers. The ends may be square or may be mitered depending on the manufacturing process.

An elastic conformance layer (not shown) can overlay the smart response unit 10 and the foam edge support 204.

Viscoelastic polyurethane foam layer 206 having a convoluted top surface and a planar bottom surface can overlay the elastic conformance layer or the planar surface defined by the support unit 10 and foam edge support 254. The viscoelastic foam layer 210 is generally characterized as having a thickness greater than 1 inch to about 5 inches, a density of less than 1 to 4 lb/ft$^3$, and a hardness of 5 to 20 pounds-force. In one embodiment, the viscoelastic polyurethane foam layer 210 has a thickness of 3 inches, a density of about 2.7 lb/ft$^3$, and a hardness of 11 pounds-force. The convolutions are ⅜ of an inch.

A cover panel 208 formed of a viscoelastic foam is disposed on the viscoelastic foam layer 210. The cover panel 212 has planar top and bottom surfaces, a density of 1 to 5 lb/ft$^3$, a hardness of 5 to 20 pounds-force, and a thickness of 0.5 to 3 inches. In one embodiment, the cover panel has a thickness of 1 inch, a density of about 3.7 lb/ft$^3$, and a hardness of about 9.5 pounds-force.

Figure 5:
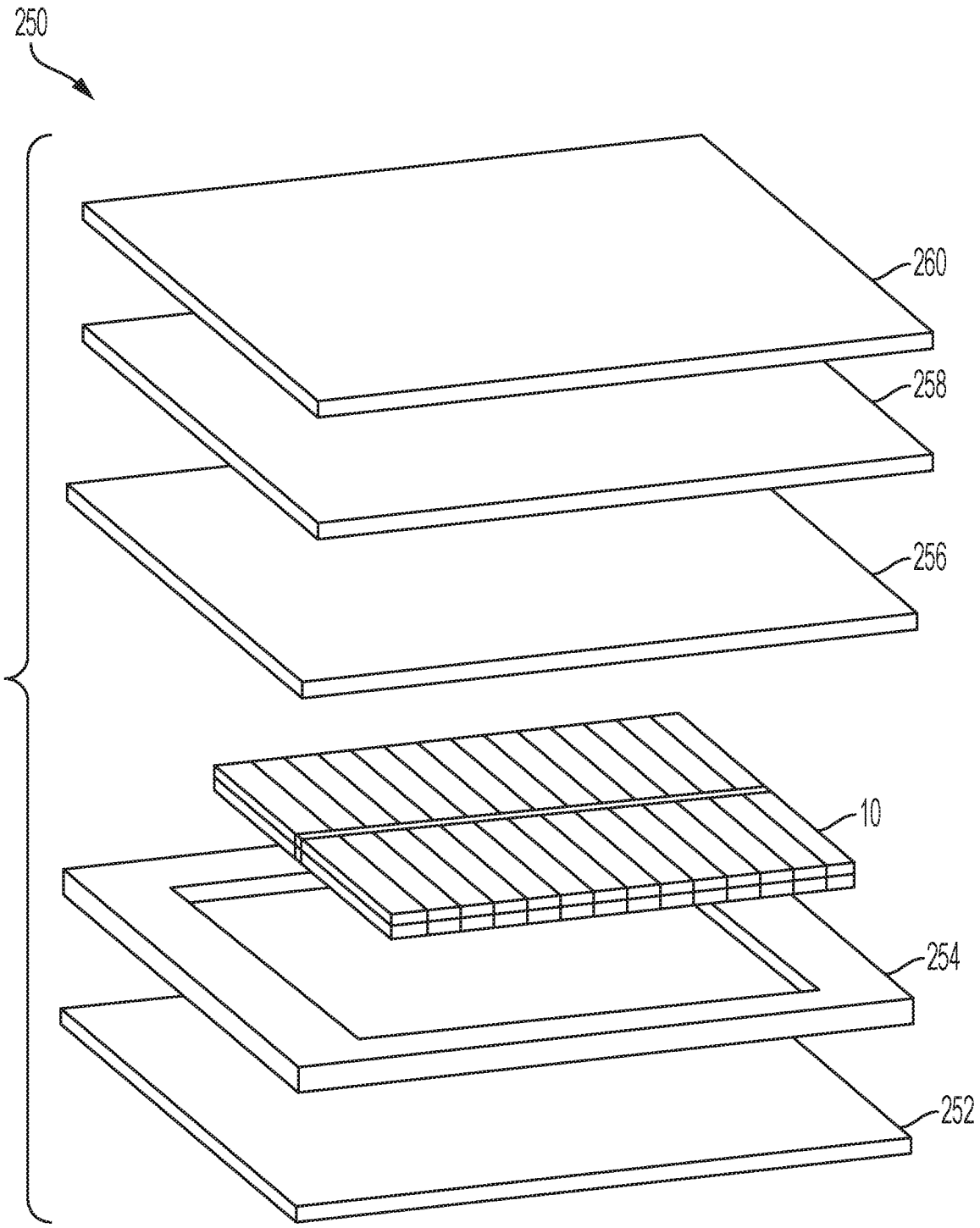
FIG. 5 illustrates an exploded perspective view of a smart response technology mattress in accordance with another embodiment of the present disclosure.

Turning now to FIG. 5, there is shown an exploded perspective view of a smart technology mattress 250 in accordance with yet another embodiment. The smart response technology mattress 250 includes a base foam layer 252. In one embodiment, the base foam, layer 252 can be formed of a standard polyurethane foam layer including planar top and bottom surfaces. In one embodiment, the polyurethane foam layer is pre-stressed. The pre-stressed polyurethane foam layer can be a standard polyurethane foam as noted above (i.e., not viscoelastic) and generally has a pre-stressed thickness of less than 1 inch to 4 inches. The density is generally less than 2.5 lb/ft$^3$ to 0.5 lb/ft$^3$ in some embodiments, and less than 2 lb/ft$^3$ to 1 lb/ft$^3$ in still other embodiments. The hardness is generally less than 60 pounds-force to 10 pounds-force in some embodiments, and less than 50 pounds-force to 30 pounds-force in still other embodiments. In one embodiment, the thickness is 2.25 inches, the hardness is 45 pounds-force, and the density is 1.5 lb/ft$^3$.

Disposed on the planar top surface of base layer 252 is a smart response unit 10 of one or more support cells such as described above in FIGS. 1-2. In one embodiment, the smart response unit includes two 8-chamber support cells, wherein each one of the 8-chamber support cells are adjacent to one another and generally configured and oriented to support an individual user.

The smart response unit 10 is disposed in an opening defined by an foam edge support 254 that circumscribes the perimeter the smart response unit. The foam edge support 254 generally defines the side rail assembly. The foam edge support has a thickness of about the same or less than the thickness of the smart response unit. By way of example, the thickness of the smart response unit 10 is 5.5 inches and the thickness of the edge support 254 is 5.25 inches. In one embodiment, the recess is off center lengthwise such that the smart response unit 10 is oriented more towards the head portion of the mattress. By way of example, the sides can have a width of 5.25 inches, the head end can have a width of 9 inches and the foot end can have a width of 21 inches.

In one embodiment, the foam edge support 254 is formed of a polyurethane foam having a density generally less than 3 lb/ft$^3$ and a hardness greater than 30 pounds-force. In one embodiment, the foam edge support 304 is formed of having a density of 1.65 lb/ft$^3$ and a hardness of 45 pounds-force.

In another embodiment, the foam edge support 304 is formed of open cell polyurethane foam having a non-random large cell structure or a random cellular structure with many large cells. The large cell structure can be defined by the number of cells per linear inch. In one embodiment, the large cell structure is about 10 to 40 cells per inch, with about 15 to 30 cells per inch in other embodiments, and with about 20 cells per inch in still other embodiments. The open cell foam structure includes a plurality of interconnected cells, wherein the windows between the adjacent cells are broken and/or removed. In contrast, in a closed cell foam there are substantially no interconnected cells and the windows between the adjacent cells are substantially intact. In reticulated foams, substantially all of the windows are removed. By using an open cell structure with a large open cellular structure, movement of moisture and air through a foam edge support 304 can occur. Also, if the foam edge support 254 is adhesively or thermally attached to any of the mattress layers, the skeletal struts of the open cell foam will bond to the mattress layers, thereby facilitating air and moisture transfer from the mattress layers through the side layers to the environment. In one embodiment, the foam edge support 304 includes a reticulated viscoelastic polyurethane foam.

For ease in manufacturing the mattress assembly, the foam edge support 304 may be assembled in linear sections that are joined to one another to form the perimeter about the mattress layers. The ends may be square or may be mitered depending on the manufacturing process.

An elastic conformance layer (not shown) can overlay the smart response unit 10 and the foam edge support 254.

A latex foam layer 256 having planar top and bottom surfaces overlays the elastic conformance layer or the planar surface defined by the support unit 10 and foam edge support 254. In one embodiment, the latex foam layer 256 includes a plurality of through-holes to provide improved air flow. The latex foam layer 309 is generally characterized as having a thickness greater than 0.25 inch to about 2 inches, a density of less than 2 to 6 lb/ft$^3$, and a hardness of 10 to 20 pounds-force. In one embodiment, the latex foam layer 309 has a thickness of ½ inch, a density of about 4 lb/ft$^3$ and a hardness of 14 pounds-force.

Viscoelastic polyurethane foam layer 258 having a convoluted top surface and a planar bottom surfaces overlays on the latex foam layer 256. The viscoelastic foam layer 258 is generally characterized as having a thickness greater than 1 inch to 5 inches, a density of less than 1 to 8 lb/ft$^3$, and a hardness of 5 to 20 pounds-force. In one embodiment, the viscoelastic polyurethane foam layer 310 has a thickness of 2.5 inches, a density of about 4.5 lb/ft$^3$, and a hardness of 11 pounds-force. The convolutions are ⅜ of an inch.

A cover panel 260 formed of a viscoelastic foam is disposed on the viscoelastic foam layer 310. The cover panel 260 has planar top and bottom surfaces, a density of 1 to 5 lb/ft$^3$, a hardness of 5 to 20 pounds-force, and a thickness of 0.5 to 3 inches. In one embodiment, the cover panel has a thickness of 1 inch, a density of about 3.7 lb/ft$^3$, and a hardness of about 9.5 pounds-force.

Figure 6:
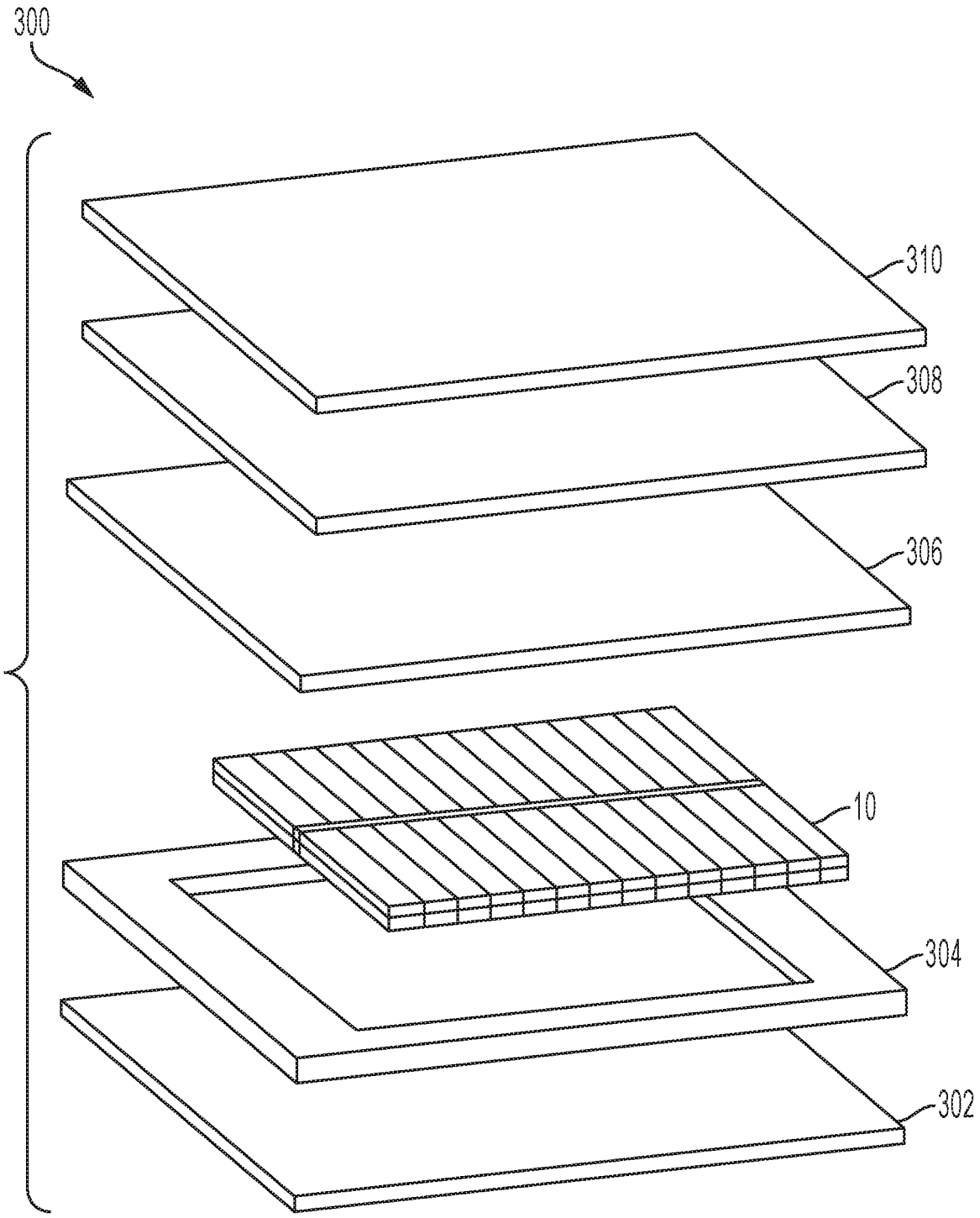
FIG. 6 illustrates an exploded perspective view of a smart response technology mattress in accordance with yet another embodiment of the present disclosure.

Turning now to FIG. 6, there is shown an exploded perspective view of a smart technology mattress in accordance with still another embodiment. The smart response technology mattress 300 includes a base foam layer 302. In one embodiment, the base foam, layer 302 can be formed of a standard polyurethane foam layer including planar top and bottom surfaces. In one embodiment, the polyurethane foam layer is pre-stressed. The pre-stressed polyurethane foam layer is a standard polyurethane foam as noted above (i.e., not viscoelastic) and generally has a pre-stressed thickness of less than 1 inch to 4 inches. The density is generally less than 2.5 lb/ft$^3$ to 0.5 lb/ft$^3$ in some embodiments, and less than 2 lb/ft$^3$ to 1 lb/ft$^3$ in still other embodiments. The hardness is generally less than 60 pounds-force to 10 pounds-force in some embodiments, and less than 50 pounds-force to 30 pounds-force in still other embodiments. In one embodiment, the thickness is 2.25 inches, the hardness is 45 pounds-force, and the density is 1.5 lb/ft$^3$.

Disposed on the planar top surface of base layer 302 is a smart response unit 10 of one or more support cells such as described above in FIGS. 1-2. In one embodiment, the smart response unit includes two 8-chamber support cells, wherein each one of the 8-chamber support cells are adjacent to one another and generally configured and oriented to support an individual user.

The smart response unit 10 is disposed in an opening defined by an foam edge support 304 that circumscribes the perimeter the smart response unit. The foam edge support 304 generally defines the side rail assembly. The foam edge support has a thickness of about the same or less than the thickness of the smart response unit. By way of example, the thickness of the smart response unit 10 is 5.5 inches and the thickness of the edge support 304 is 5.25 inches. In one embodiment, the recess is off center lengthwise such that the smart response unit 10 is oriented more towards the head portion of the mattress. By way of example, the sides can have a width of 5.25 inches, the head end can have a width of 9 inches and the foot end can have a width of 21 inches.

In one embodiment, the foam edge support 304 is formed of a polyurethane foam having a density generally less than 3 lb/ft$^3$ and a hardness greater than 30 pounds-force. In one embodiment, the foam edge support 304 is formed of having a density of 1.65 lb/ft$^3$ and a hardness of 45 pounds-force.

In another embodiment, the foam edge support 304 is formed of open cell polyurethane foam having a non-random large cell structure or a random cellular structure with many large cells. The large cell structure can be defined by the number of cells per linear inch. In one embodiment, the large cell structure is about 10 to 40 cells per inch, with about 15 to 30 cells per inch in other embodiments, and with about 20 cells per inch in still other embodiments. The open cell foam structure includes a plurality of interconnected cells, wherein the windows between the adjacent cells are broken and/or removed. In contrast, in a closed cell foam there are substantially no interconnected cells and the windows between the adjacent cells are substantially intact. In reticulated foams, substantially all of the windows are removed. By using an open cell structure with a large open cellular structure, movement of moisture and air through a foam edge support 304 can occur. Also, if the foam edge support 304 is adhesively or thermally attached to any of the mattress layers, the skeletal struts of the open cell foam will bond to the mattress layers, thereby facilitating air and moisture transfer from the mattress layers through the side layers to the environment. In one embodiment, the foam edge support 304 includes a reticulated viscoelastic polyurethane foam.

For ease in manufacturing the mattress assembly, the foam edge support 304 may be assembled in linear sections that are joined to one another to form the perimeter about the mattress layers. The ends may be square or may be mitered depending on the manufacturing process.

An elastic conformance layer (not shown) can overlay the smart response unit 10 and the foam edge support 304.

A viscoelastic polyurethane foam layer 306 having planar top and bottom surfaces can overlay the elastic conformance layer or the planar surface defined by the support unit 10 and foam edge support 304. The viscoelastic foam layer 306 is generally characterized as having a thickness greater than 1 inch to about 3 inches, a density of less than 2 to 6 lb/ft$^3$, and a hardness of 5 to 20 pounds-force. In one embodiment, the viscoelastic foam layer 409 has a thickness of 1.5 inches, a density of about 4.5 lb/ft$^3$, and a hardness of 11 pounds-force.

Viscoelastic polyurethane foam layer 308 having a convoluted top surface and a planar bottom surfaces overlays on the viscoelastic foam layer 306. The viscoelastic foam layer 308 is generally characterized as having a thickness greater than 1 inch to about 5 inches, a density of less than 2 to 6 lb/ft$^3$, and a hardness of 5 to 20 pounds-force. In one embodiment, the viscoelastic polyurethane foam layer 306 has a thickness of 2 inches, a density of about 4.5 lb/ft$^3$, and a hardness of 11 pounds-force. The convolutions are ⅜ of an inch.

A cover panel 310 formed of a viscoelastic foam is disposed on the viscoelastic foam layer 410. The cover panel 310 has planar top and bottom surfaces, a density of 1 to 5 lb/ft$^3$, a hardness of 5 to 20 pounds-force, and a thickness of 0.5 to 3 inches. In one embodiment, the cover panel has a thickness of 1 inch, a density of about 3.7 lb/ft$^3$, and a hardness of about 9.5 pounds-force.

The above mattresses may be of any size, including standard sizes such as a twin, queen, oversized queen, king, or California king sized mattress, as well as custom or non-standard sizes constructed to accommodate a particular user or a particular room.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A smart response technology mattress comprising:

a sub-core assembly comprising a base layer, wherein the base layer is a pre-stressed polyurethane foam;

a second layer overlaying the base layer comprising a self-adjusting, non-powered smart response unit and a polyurethane foam including an opening circumscribing a perimeter of the smart response unit and having a thickness equal to or less than a thickness of the smart response unit, wherein the smart response unit comprises a plurality of fluid support cells, wherein each fluid support cell includes an envelope and a reforming element disposed within the envelope, wherein the opening in the polyurethane foam is longitudinally offset such that the smart response unit is oriented more towards a head end of the mattress;

a non-powered manifold system including a manifold conduit interconnecting at least two of the fluid support cells, and intake and exhaust valves fluidly coupled to the manifold conduit configured to dynamically open and close in response to a weight load;

and an elastic conformance layer overlaying a planar surface defined by the smart response unit and the polyurethane foam circumscribing the perimeter of the smart response unit, wherein the polyurethane foam is an open cell foam having a large cell structure of about 10 to about 40 cells per inch;

a viscoelastic foam layer overlaying the sub-core assembly having a convoluted top surface and a planar bottom surface; and a cover layer overlaying the viscoelastic foam layer, the cover layer comprising a viscoelastic foam having planar top and bottom surfaces.

2. The smart response technology mattress of claim 1, wherein the cover layer has a density of 1 to 5 lb/ft$^3$, a hardness of 5 to 20 pounds-force, and a thickness of 0.5 to 3 inches.

3. The smart response technology mattress of claim 1, wherein the viscoelastic foam layer has a thickness greater than 1 inch to about 3 inches, a density of less than 1 to 3 1 lb/ft$^3$, and a hardness of 5 to 20 pounds-force.

4. The smart response technology mattress of claim 1, wherein the smart response unit comprises two adjacent 8-chamber fluid cells configured and oriented to support an individual user.

5. The smart response technology mattress of claim 1, wherein the polyurethane foam circumscribing a perimeter of the smart response unit is adhesively or thermally attached to the viscoelastic foam layer overlaying the sub-core assembly.

6. A smart response technology mattress comprising:

a sub-core assembly comprising a base layer, wherein the base layer is a pre-stressed polyurethane foam;

a second layer overlaying the base layer comprising a self-adjusting, non-powered smart response unit and a polyurethane foam including an opening circumscribing a perimeter of the smart response unit and having a thickness equal to or less than a thickness of the smart response unit, wherein the smart response unit comprises a plurality of fluid support cells, wherein the opening in the pre-stressed polyurethane foam is longitudinally offset such that the smart response unit is oriented more towards a head end of the mattress, wherein each fluid support cell includes an envelope and a reforming element disposed within the envelope; a non-powered manifold system including a manifold conduit interconnecting at least two of the fluid support cells, and intake and exhaust valves fluidly coupled to the manifold conduit configured to dynamically open and close in response to a weight load; and an elastic conformance layer overlaying a planar surface defined by the smart response unit and the polyurethane foam circumscribing the perimeter of the smart response unit, wherein the polyurethane foam is an open cell foam having a large cell structure of about 10 to about 40 cells per inch;

a latex foam layer overlaying the sub-core having a planar top and bottom surface;

a viscoelastic foam layer overlaying the latex foam layer having a convoluted top surface and a planar bottom surface; and a cover layer overlaying the layer overlaying the sub-core, the cover layer comprising a viscoelastic foam having planar top and bottom surfaces.

7. The smart response technology mattress of claim 6, wherein the latex foam layer has a thickness greater than 0.25 inch to about 2 inches, a density of less than 2 to 6 lb/ft$^3$, and a hardness of 10 to 20 pounds-force.

8. The smart response technology mattress of claim 6, wherein the cover layer has a density of 1 to 5 lb/ft$^3$, a hardness of 5 to 20 pounds-force, and a thickness of 0.5 to 3 inches.

9. The smart response technology mattress of claim 6, wherein the viscoelastic foam layer has a thickness greater than 1 inch to 3 inches, a density of less than 1 to 8 lb/ft$^3$, and a hardness of 5 to 20 pounds-force.

10. The smart response technology mattress of claim 6, wherein the smart response unit comprises two adjacent 8-chamber fluid cells configured and oriented to support an individual user.

11. The smart response technology mattress of claim 6, wherein the polyurethane foam circumscribing a perimeter of the smart response unit is adhesively or thermally attached to the latex foam layer overlaying the sub-core assembly.

12. A smart response technology mattress comprising:

a sub-core assembly comprising a base layer, wherein the base layer is a pre-stressed polyurethane foam;

a second layer overlaying the base layer comprising a self-adjusting, non-powered smart response unit and a polyurethane foam including an opening circumscribing a perimeter of the smart response unit and having a thickness equal to or less than a thickness of the smart response unit, wherein the opening in the polyurethane foam is longitudinally offset such that the smart response unit is oriented more towards a head end of the mattress, wherein the smart response unit comprises a plurality of fluid support cells, wherein each fluid support cell includes an envelope and a reforming element disposed within the envelope; a non-powered manifold system including a manifold conduit interconnecting at least two of the fluid support cells, and intake and exhaust valves fluidly coupled to the manifold conduit configured to dynamically open and close in response to a weight load; and an elastic conformance layer overlaying a planar surface defined by the smart response unit and the polyurethane foam circumscribing the perimeter of the smart response unit, wherein the polyurethane foam is an open cell foam having a large cell structure of about 10 to about 40 cells per inch;

a first viscoelastic foam layer overlaying the sub-core having a planar top and bottom surfaces;

a second viscoelastic foam layer overlaying the first viscoelastic foam layer having a convoluted top surface and a planar bottom surface; and a cover layer overlaying the layer overlaying the sub-core, the cover layer comprising a viscoelastic foam having planar top and bottom surfaces.

13. The smart response technology mattress of claim 12, wherein the cover layer has a density of 1 to 5 lb/ft$^3$, a hardness of 5 to 20 pounds-force, and a thickness of 0.5 to 3 inches.

14. The smart response technology mattress of claim 12, wherein the first viscoelastic foam layer has a thickness greater than 1 inch to about 3 inches, a density of less than 2 to 6 lb/ft$^3$, and a hardness of 5 to 20 pounds-force.

15. The smart response technology mattress of claim 12, wherein the smart response unit comprises two adjacent 8-chamber fluid cells configured and oriented to support an individual user.

16. The smart response technology mattress of claim 12, wherein the second viscoelastic foam layer has a thickness greater than 1 inch to about 5 inches, a density of less than 2 to 6 lb/ft$^3$, and a hardness of 5 to 20 pounds-force.

17. The smart response technology mattress of claim 12, wherein the polyurethane foam circumscribing a perimeter of the smart response unit is adhesively or thermally attached to the first viscoelastic foam layer overlaying the sub-core assembly.

* * * * *